United States Patent [19]

Piegay

[11] Patent Number: 4,865,345

[45] Date of Patent: Sep. 12, 1989

[54] VIBRATION DAMPER FOR SKI

[75] Inventor: Yves Piegay, Voiron, France

[73] Assignee: Skis Rossignol S.A., Voiron, France

[21] Appl. No.: 234,968

[22] Filed: Aug. 19, 1988

Related U.S. Application Data

[60] Division of Ser. No. 132,730, Dec. 11, 1987, which is a continuation of Ser. No. 814,110, Dec. 27, 1985, abandoned.

[30] Foreign Application Priority Data

Dec. 27, 1984 [FR] France ..... 84 20189

[51] Int. Cl.[4] ..... A63C 5/075

[52] U.S. Cl. ..... 280/602; 188/379; 248/634; 267/141

[58] Field of Search ..... 280/601, 602, 610; 267/140.2, 141, 141.1, 158; 248/634, 635; 188/379, 380

[56] References Cited

U.S. PATENT DOCUMENTS 3,537,717 11/1970 Caldwell ..... 280/602
3,901,522 8/1975 Boehm ..... 280/610
4,405,149 9/1983 Piegay ..... 280/602
4,438,946 3/1984 Piegay ..... 280/602
4,563,020 1/1986 Arieh et al. ..... 188/378
4,627,635 12/1986 Koleda ..... 280/602

*Primary Examiner*—Charles A. Marmor
*Assistant Examiner*—Eric Culbreth
*Attorney, Agent, or Firm*—Herbert Dubno; Andrew M. Wilford

[57] ABSTRACT

A vibration damper is used in combinataion with a ski having an upper surface, a turned up front end, a rear end, and a central ski binding on the upper surface. The damper is between 5 cm and 20 cm long and comprises a viscoelastic sheet flatly engaging the upper surface immediately behind the front end, immediately ahead of the rear end, or immediately ahead of the ski binding and a damper plate with a high modulus of elasticity overlying the viscoelastic sheet. The plate is secured atop the sheet on the upper ski surface. The damper is between 10% and 20% of the length of the ski from the rear end of the ski, between 65% and 75% of the length of the ski from the rear end, and/or between 85% and 97% of the length of the ski from the rear end. A 2 m ski normally has a distance of 180 cm between the rear end of the ski and the start of the front upturned end of the ski.

5 Claims, 2 Drawing Sheets

VIBRATION DAMPER FOR SKI

CROSS-REFERENCE TO RELATED APPLICATIONS

This application is a division of application 132,730 filed Dec. 11, 1987 which itself is a file-wrapper-continuation of now abandoned application 814,1100 filed Dec. 27, 1985.

FIELD OF THE INVENTION

The present invention relates to a ski. More particularly this invention concerns a vibration damper for a snow ski.

BACKGROUND OF THE INVENTION

When sliding on snow a standard ski frequently vibrates. When such vibrations become fairly strong they can not only be uncomfortable for the skier, but they can cause the ski to lose contact with the snow, causing a loss of stability and ability to hold and guide the skier on the snow.

Accordingly it is known from U.S. Pat. No. 3,901,522 to provide a ski with a longitudinally extending viscoelastic layer that effectively damps such vibrations, making the ski fairly dead. In U.S. Pat. No. 3,537,717 such a viscoelastic strip is mounted on the top surface of the ski all the way from the binding to the start of the upturned front end. Such an arrangement has been found ineffective because it suppresses all vibrations and makes the ski so dead and unresponsive that it is fairly difficult to use at all.

It has been learned that, although some vibrations are bad when they exceed a certain limit, certain other vibrations, so long as they stay within certain limits, are no problem at all and in fact impart a lively easy-to-control feel to the ski. Accordingly commonly owned U.S. Pat. Nos. 4,405,149 and 4,438,946 describe skis into which are integrated strips of viscoelastic material whose positions and lengths are determined as a function of the particular vibrations to be damped. Thus the type of skiing or skier determines the type of vibration damper used, e.g. skis for a giant slalom or for a special are differently damped. Such an arrangement still fails to take into account the various types of skis, skiers, and skiing.

OBJECTS OF THE INVENTION

It is therefore an object of the present invention to provide an improved vibration-damping system for a ski.

Another object is the provision of such a vibration damper for a ski which overcomes the above-given disadvantages, that is which extends the principles of the above-identified patents by making the skis particularly usable for different types of skiing and skiers.

SUMMARY OF THE INVENTION

A vibration damper according to the invention is used in combination with a ski having an upper surface, a turned up front end, a rear end, and a central ski binding on the upper surface. The damper is between 5 cm and 20 cm long and comprises a viscoelastic sheet flatly engaging the upper surface immediately behind the front end, immediately ahead of the rear end, or immediately ahead of the ski binding, and a damper plate with a high modulus of elasticity overlying the viscoelastic sheet. The plate is secured atop the sheet on the upper ski surface.

It has surprisingly been found that the positions according to this invention allow the damping to be exactly tailored to the individual circumstances by placing it just where it is most ideally effective. Since the normal damper according to this invention has a length of between 5 cm and 20 cm, as compared to the average ski which is about 2 m long or ten times the length of the damper, these positions are fairly exact while permitting some adjustment latitude.

Thus according to more specific features of the invention the damper is between 10% and 20% of the length of the ski from the rear end of the ski, between 65% and 75% of the length of the ski from the rear end, and/or between 85% and 97% of the length of the ski from the rear end. A 2 m ski normally has a distance of 180 cm between the rear end of the ski and the start of the front upturned end of the ski, that is a 180 cm line of contact with the snow.

According to another feature of this invention there is an adhesive bonding the sheet to the plate and an adhesive bonding the sheet to the upper ski surface. In addition the means securing the sheet and plate to the ski is displaceable limitedly longitudinally of the ski for variable placement of the damper, of course within the above-defined limits.

The damper of this invention also has a bottom plate having a high modulus of elasticity between the sheet and the upper ski surface and an upper plate of a high modulus of elasticity and having a pair of raised portions overlying the bottom plate and sandwiching the damper plate and sheet with the bottom plate. The upper plate has a portion immediately juxtaposed with the bottom plate and the bottom and upper plates are formed at the immediately juxtaposed regions with a throughgoing slot. A bolt constitutes the means engaged through the slot in the ski. More specifically the upper plate has two raised portions flanking the juxtaposed region and the sheet and damper plate are in two sections, one section of each under each of the upper-plate portions.

The damper according to this invention has a second such sheet joined to the plate which is sandwiched between the two sheets, and a stiff cap covering and containing the two sheets and plate. This cap is fixed to the ski.

In accordance with another feature of the invention the upper surface of the ski has a roughened region engaging the sheet with a high coefficient of friction and a cover plate sandwiches the damper plate with the sheet and is secured to the ski. A lubricant forms a low coefficient of friction between the damper plate and the cover plate.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figures 1, 2, 3, 4, 5:
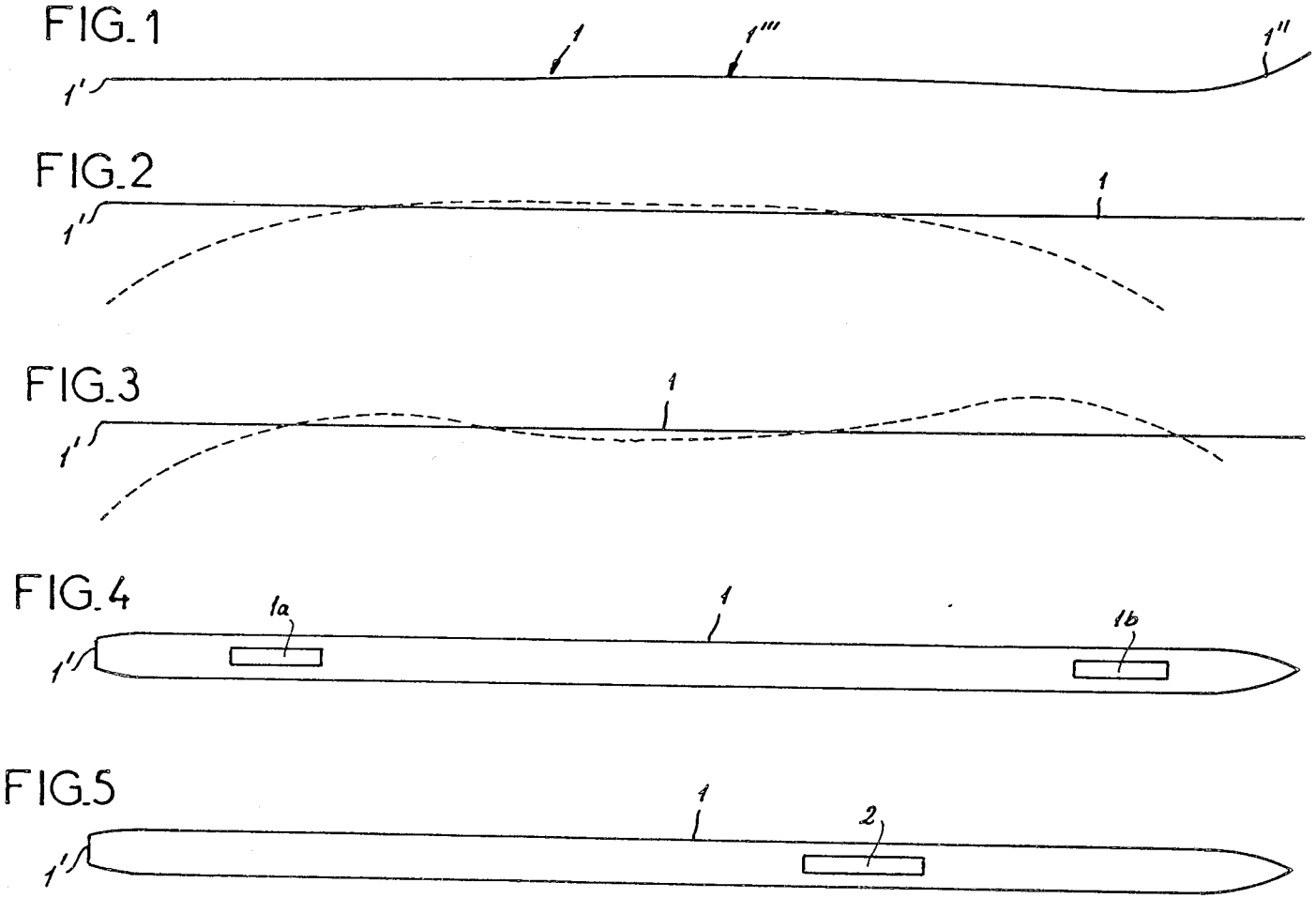
FIG. 1 is a schematic side view of a ski.
FIGS. 2 and 3 are schematic side views illustrating the bending of special- and grand-slalom skis.
FIGS. 4 and 5 are top views of special- and grand-slalom skis equipped with dampers according to this invention.

As seen in FIG. 1 a standard ski 1 has a rear end 1', an upturned front end 1'', and a central region 1''' for a binding, the total ski having a length of 2 m with the upturned front region having a length of 20 cm. FIG. 2 shows in dashed lines how this ski can be deformed at a maximum when it is used in special slalom, that is mainly downwardly concave, and FIG. 3 shows the double concave or M-shape it can achieve in grand slalom.

FIG. 4 shows how the deflections of FIG. 3 can be eliminated by mounting vibration dampers 1*a* and 1*b* on the ski 1. The dampers 1*a* and 1*b* each are 15 cm long and the center of the damper 1*a* is 27.5 cm from the rear end 1' of the ski while that of the damper 1*b* is 167 cm from this rear end 1'. In FIG. 5 the damper 2 is 20 cm long and has a center 128 cm from the rear end 1' of the ski. Each such damper 1*a*, 1*b*, or 2 is formed by one or more layers of a viscoelastic material bonded adhesively with one or more plates of a material of a high modulus of elasticity, for example an alloy of aluminum or a or a synthetic-resin reinforced with glass or carbon fibers.

Figure 6:
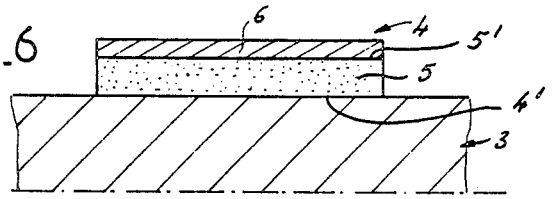
FIGS. 6, 7, and 8 are cross sections through skis according to this invention.

As seen in FIG. 6 a ski 3 has an upper surface carrying a damper 4 formed of a strip 5 of viscoelastic material secured by an adhesive 5' to a plate 6 of a material of a high modulus of elasticity for example of Zicral TM. This damper 4 is in turn secured by an adhesive 4' to the ski 3 in a location as described above determine by the type of vibration to be damped.

Figure 7:
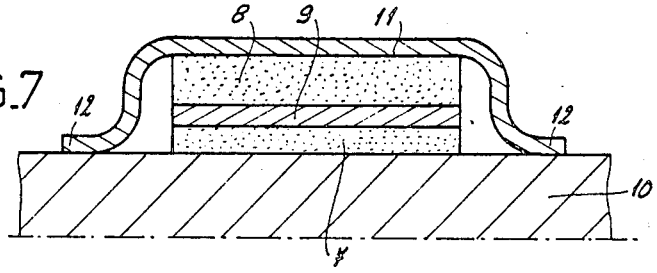

Since the damper works in shear it is possible to increase its effectiveness by increasing the number of viscoelastic layers used. Thus as seen in FIG. 7 two layers 7 and 8 of the viscoelastic material are used, both bonded to a Zicral TM plate 9 by an appropriate adhesive. The three-part sandwich thus formed is secured to the ski 10 by a cap 11 which can also be of Zicral TM and which is omega-shaped with two side tabs 12 formed with slots through which bolts secure the assembly to the ski 10.

Figure 8:
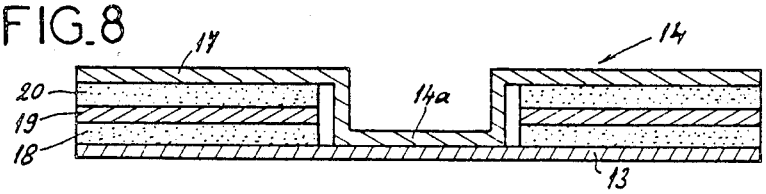
Figure 9:
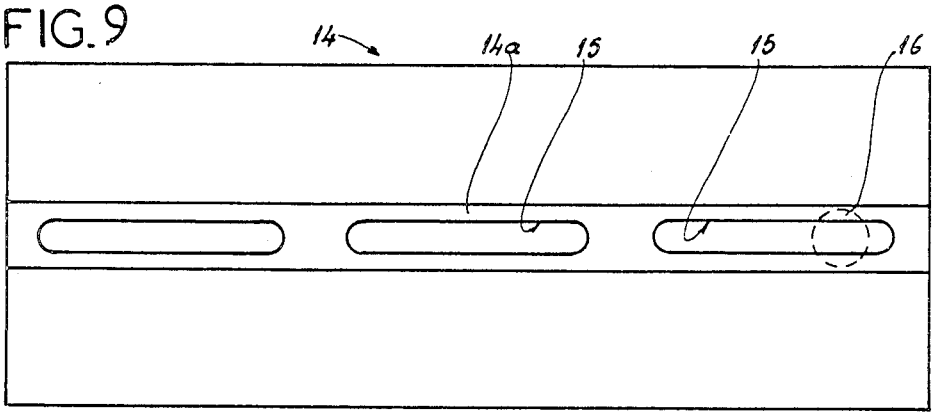
FIG. 9 is a top view of a portion of the ski of FIG. 8.

The system of FIGS. 8 and 9 basically comprises two side-by-side dampers each formed by a pair of viscoelastic strips 18 and 20 bonded to and sandwiching a Zicral TM strip 19. The lower strips 18 are bonded to a common bottom plate 13 and the upper strips 20 are bonded to raised wings 17 of a top plate 14 having a depressed central region 14*a* formed with longitudinal slots 15 into which bolts 16 engage (as in FIG. 7) to secure the assembly to a ski, with the possibility of some longitudinal adjustment.

Figure 10:
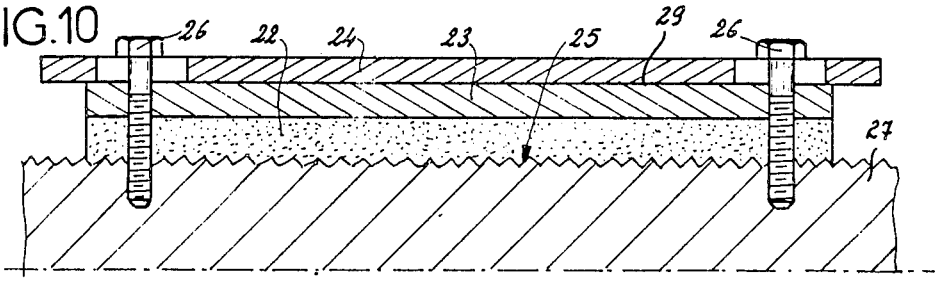
FIG. 10 is a longitudinal section through another ski according to the present invention.

In FIG. 10 a viscoelastic layer 22 is bonded to a Zicral plate 23 held down by a plate 24 secured to a ski 27 by bolts 26. A silicone lubricant 29 is provided between the plates 23 and 24 to give it a very low coefficient $f_1$ of friction. The upper surface 25 of the ski 27 is, however, fairly rough to create a high coefficient $f_2$ of friction between it and the bottom surface of the layer 22. This system can be positioned to damp just those vibrations that create problems for a particular skier using a particular kind of ski for a particular kind of skiing.

The instant invention is not limited to the embodiments or usages shown. It can be applied to any type of ski, even a monoski or cross-country ski.

I claim:

1. In combination with a ski having a length of about 2 m, an upper surface, a turned-up front end, a rear end, and a central ski binding, a vibration damper system between 5 cm and 20 cm long and comprising:

a rear viscoelastic sheet lying above the upper surface immediately behind the front end;

a front viscoelastic sheet lying above the upper surface immediately ahead of the rear end, the upper surface being substantially free of any structure between the sheets and the front and rear ski ends except for the binding;

respective rear and front damper plates with a high modulus of electricity overlying the viscoelastic sheets;

means for securing the plates atop the sheets on the upper ski surface;

a respective bottom plate having a high modulus of elasticity between each sheet and the upper ski surface;

a respective upper plate having a high modulus of elasticity having a pair of raised portions overlying the respective bottom plate and sandwiching the respective damper plate and sheet with the respective bottom plate, each upper plate having a portion immediately juxtaposed with the respective bottom plate, the bottom and upper plates each being formed at the immediately juxtaposed regions with a throughgoing slot; and respective bolts engaged through the slots into the ski and constituting said means for securing.

2. The combination defined in claim 1 wherein each of the two raised portions of the upper plate flank the juxtaposed region and the respective sheet and damper plate are in two sections, one under each of the respective upper-plate portions.

3. The combination defined in claim 1 wherein the rear sheet and plate are between 10% and 20% of the length of the ski from the rear end of the ski, and the front sheet and plate are between 85% and 97% of the length of the ski from the rear end.

4. The combination defined in claim 1, further comprising an adhesive bonding each sheet to the respective plate.

5. The combination defined in claim 1 wherein the means securing the sheets and plates to the ski is displaceable limitedly longitudinally of the ski for variable placement of the damper.

* * * * *